US012624624B2

(12) United States Patent
Dong et al.

(10) Patent No.: US 12,624,624 B2
(45) Date of Patent: May 12, 2026

(54) METHOD OF ARTIFICIALLY ASSISTED FILLING FOR SAND CONTROL AND WATER CONTROL OF FRACTURED RESERVOIR AND METHOD FOR EVALUATING FILLING EFFECT

(71) Applicants: China University of Petroleum (East China), Dongying (CN); Tianjin Dagang Drilling Technology Co., Ltd., Tianjin (CN)

(72) Inventors: Changyin Dong, Dongying (CN); Honggang Liu, Dongying (CN); Qiang Song, Dongying (CN); Huaiwen Li, Tianjin (CN); Haoyu Wang, Dongying (CN); Haobin Bai, Dongying (CN); Guolong Li, Dongying (CN); Chao Wang, Tianjin (CN); Tao Sun, Tianjin (CN); Wei Liu, Tianjin (CN)

(73) Assignees: China University of Petroleum (East China), Dongying City (CN); Tianjin Dagang Drilling Technology Co., Ltd., Tianjin City (CN)

( * ) Notice: Subject to any disclaimer, the term of this patent is extended or adjusted under 35 U.S.C. 154(b) by 0 days.

(21) Appl. No.: 19/321,256

(22) Filed: Sep. 7, 2025

(65) Prior Publication Data

US 2026/0002432 A1 Jan. 1, 2026

Related U.S. Application Data

(63) Continuation of application No. PCT/CN2025/096765, filed on May 23, 2025.

(30) Foreign Application Priority Data

May 24, 2024 (CN) ..... 202410654176.2

(51) Int. Cl.
*E21B 43/267* (2006.01)

(52) U.S. Cl.
CPC ..... *E21B 43/267* (2013.01)

(58) Field of Classification Search
None
See application file for complete search history.

(56) References Cited

U.S. PATENT DOCUMENTS

| | | | | |
|---|---|---|---|---|
| 2021/0270114 | A1* | 9/2021 | Chen | E21B 43/26 |
| 2022/0049591 | A1 | 2/2022 | Peng et al. | |
| 2023/0203929 | A1* | 6/2023 | Chen | E21B 43/267 166/280.2 |

FOREIGN PATENT DOCUMENTS

| | | | |
|---|---|---|---|
| CN | 106372377 | A | 2/2017 |
| CN | 111666726 | A | 9/2020 |
| CN | 113532996 | A | 10/2021 |

* cited by examiner

*Primary Examiner* — Andrew Sue-Ako
(74) *Attorney, Agent, or Firm* — Nitin Kaushik

(57) ABSTRACT

The present invention belongs to the technical field of oil and gas engineering, and discloses a method of artificially assisted filling for sand control and water control of a fractured reservoir and a method for evaluating a filling effect. The method of artificially assisted filling for sand control and water control of the fractured reservoir comprises the steps: S11, calculating a fracture productivity evaluation index F of the fractured reservoir; S12, calculating an implementation feasibility index G of an artificially assisted filling process; S13, based on the fracture productivity evaluation index F obtained in step S11 and the implementation feasibility index G of the artificially assisted filling process obtained in the step S12, selecting one of a natural micro-saturation filling process, an artificially assisted extrusion supersaturation filling process or an artificially assisted fracturing strong saturation filling process for filling.

8 Claims, 8 Drawing Sheets

METHOD OF ARTIFICIALLY ASSISTED FILLING FOR SAND CONTROL AND WATER CONTROL OF FRACTURED RESERVOIR AND METHOD FOR EVALUATING FILLING EFFECT

CROSS-REFERENCE TO RELATED APPLICATIONS

The application claims priority to Chinese patent application No. 202410654176.2, filed on May 24, 2024, the entire contents of which are incorporated herein by reference.

TECHNICAL FIELD

The present invention belongs to the technical field of oil and gas engineering, and particularly relates to a method of artificially assisted filling for sand control and water control of a fractured reservoir and a method for evaluating a filling effect.

BACKGROUND

Fractured oil and gas reservoirs, such as deep fractured carbonate rock oil and gas reservoirs and fractured dense sandstone gas reservoirs in the Tarim Basin in China, have large reserve volumes, and are main target reservoirs for current and future deep oil and gas development. As shown in FIG. 1, there are natural fractures 2 which are different in width, angle and length, are interconnected or are not interconnected in a fractured reservoir 1. Natural fractures 2 are main oil and gas reservoir spaces and permeable channels. Oil and gas reservoirs having natural fracture development are prone to having sand production phenomena during exploitation, i.e., filling in the fractures undergoes slippage crushing under the action of ground stress and production pressure differentials, and formed reservoir produced sand particles 4 are discharged from a wellbore 3 with a fluid, a direction of an arrow in FIG. 1 is a direction of discharging the reservoir produced sand particles 4; and meanwhile, if the reservoir has edge and bottom water 5 that is relatively close in distance, inrush of the edge and bottom water 5 along fractures with larger widths and better liquidity is easy to occur, resulting in early water breakthrough. The problem of sand and water production is one of the key issues limiting the efficient development of fractured oil and gas reservoirs, and efficient sand control and water control are significant technical needs for efficient exploitation of such oil and gas reservoirs.

A patent document with Publication No. CN106372377A discloses a fine silt oil layer filling and sand control method, a sand control measure layer and a construction limit pressure are scientifically set according to self-characteristics of a fine silt oil layer, and a recoverable property of a barrier rock by elastic deformation is used for reducing an extent of a fracture extending to a water layer after extrusion and filling, thereby ensuring the sand control effectiveness, and extending the sand control life. The filling method of this patent document is suitable for hydrophobic sandstone sand production wells, and a loss mechanism, a filling mechanism and a filling pattern of natural fractures in fractured reservoirs are much different from those of hydrophobic sandstone sand production wells, so that the filling method disclosed in this patent is not suitable for the fractured reservoirs.

Key issues yet to exist with current sand control and water control process technologies for fractured carbonate rock and sandstone reservoirs include:

(1) Completion manners of the fractured carbonate rock and sandstone reservoirs are currently dominated by open hole completion, have no sand control function, and easily cause well wall destabilizing collapse and silt production during production, and the wellbore is buried by sand, causing a severe effect on normal production, and increasing maintenance operation costs. Attempts have begun in recent years to run perforated pipes, slotted pipes or other sand control screens into wellbores for sand control and collapse control completion, but the effects are difficult to meet production requirements.

(2) The water control technologies for fractured reservoirs are at its beginning, and a small number of tentatively applied water control technologies mainly follow a conventional inflow control device (ICD) for controlling water by screens, which can only achieve regulation of oil and water flow in the wellbores, with a limited scope and effectiveness.

(3) At current, sand control and water control cannot be combined for sand production and water production issues for fractured reservoirs, most of them are achieved inside the wellbores by tubular columns, and it is difficult to drill down inside the reservoirs; and the lack of a sand control and water control integration technology for fractured oil and gas reservoirs severely limits the sand control and water control effect of fractured oil and gas reservoirs.

SUMMARY

In order to solve the drawbacks in the prior art, the present invention discloses a method of artificially assisted filling for sand control and water control of a fractured reservoir and a method for evaluating a filling effect, which adopt the following technical solutions:

To facilitate the understanding of the technical solutions of the present invention, a principle of the filling method according to the present invention will first be described with reference to FIG. 2, the principle of the technology of artificially assisted filling for sand control and water control of the fractured reservoir according to the present invention is: a proppant having a water control and sand control function is carried and filled into a natural fracture having a larger width near a wellbore or filled into a natural fracture opened by artificial assistance to have a larger width using a sand carrying liquid, the proppant achieves a densely filled state in the fracture, which can not only block formation sand production but also retard the water breakthrough time, thereby achieving sand and water cooperative control.

The structures of different natural fractures and the degrees of matching with water control and sand control proppants are different; and in order to select a more optimal filling solution for different natural fractures, the present invention specifically refines the technology of artificially assisted filling for sand and water cooperative control of fractured reservoirs into three filling processes, each of which is applicable as follows:

I. A natural micro-saturation filling process: this process is suitable for reservoirs with natural fractures which have larger widths and higher densities and are easy to achieve natural filling, such natural fractures do not require high-intensity pumping conditions in the natural state, and slit widths are capable of receiving and containing the proppant, thereby achieving micro-saturation filling. It is as shown in FIGS. 3*a*, 3*b*. FIG. 3*a* shows a state of a natural fracture with a larger width before filling, FIG. 3*b* is a schematic view of FIG. 3*a* after filling using the natural micro-saturation filling process, where 6 in FIG. 3*b* is the natural fracture after filling using the natural micro-saturation filling process, the natural fracture has expanded its slit width by a factor of 1-1.2, and as can be seen from the natural fracture 6 after filling using the natural micro-saturation filling process and a wellbore annulus portion 9 after filling, a fraction of the proppant in the natural fracture is smaller than a fraction of the proppant in the wellbore annulus portion 8. The natural micro-saturation filling process can achieve a desired scale of filling strength without excessive flared extension of the fracture.

II. An artificially assisted extrusion supersaturation filling process: this process is suitable for reservoirs with natural fractures which have smaller widths and difficult to absorb solid particles, requires supersaturation (supersaturation means that a containment volume of the fracture itself is exceeded) extrusion filling by using reasonably higher pump pressures, displacements and sand ratios, and appropriately open the fracture to a certain extent to allow it to absorb and contain a certain amount of filling particles. It is as shown in FIGS. 4*a*, 4*b*. FIG. 4*a* shows a state of a natural fracture with a smaller width before filling, FIG. 4*b* is a schematic view of FIG. 4*a* after filling using the artificially assisted extrusion supersaturation filling process, where 7 in FIG. 4*b* is the natural fracture after filling using the artificially assisted extrusion supersaturation filling process, the natural fracture has expanded its slit width by a factor of 1.2-1.8, and similarly, a fraction of the proppant in the natural fracture is smaller than a fraction of the proppant in the wellbore annulus portion 8. The artificially assisted extrusion supersaturation filling process allows proper stretching of the natural fracture that does not meet the filling conditions initially to achieve a desired scale of filling strength without excessive flared extension of the fractures.

III. An artificially assisted fracturing strong saturation filling process: It is suitable for reservoirs with natural fractures having a very small slit width and a short slit length. Higher-strength filling construction parameters are required to allow the reservoirs to crush open to achieve a desired scale of filling strength for water control and sand control. However, a fracturing scale should be tightly controlled to avoid a negative effect of creating larger fractures to induce water inrush along the fractures, as shown in FIGS. 5*a*, 5*b*, FIG. 5*a* shows a state of a natural fracture with a very small width before filling, FIG. 5*b* is a schematic view of FIG. 5*a* after filling using the artificially assisted fracturing strong saturation filling process, where 10 in FIG. 5*b* is the natural fracture after filling using the artificially assisted fracturing strong saturation filling process, the natural fracture after filling has expanded its slit width by a factor of more than 1.8, and similarly, a fraction of the proppant in the natural fracture is smaller than a fraction of the proppant in the wellbore annulus portion 8. The artificially assisted fracturing strong saturation filling process allows substantial stretching of the natural fracture that does not meet the filling conditions initially to achieve a desired scale of filling strength without excessive flared extension of the fractures.

Based on this, how to determine which of the above-mentioned filling modes the natural fractures in the reservoir are particularly suitable for becomes the key to the artificial assisted filling of fractured reservoirs, and on this basis, the present invention discloses a method of artificially assisted filling for sand control and water control of a fractured reservoir, including the following steps:

S11, a fracture productivity evaluation index of the fractured reservoir is calculated:

The present invention easily and rapidly evaluates a fracture productivity according to a fracture width range, fracture length range, fracture dip angle range, fracture flatness, and fracture density of natural fractures of the fractured reservoir:

A fracture width is characterized using $w_{fmax}$, $w_{fa}$ and $w_f$, representing a maximum slit width, average slit width and characteristic slit width of the fracture, respectively, in mm. The larger the average slit width and the characteristic slit width, the more favorable the fracture to receive a proppant, and the easier the filling construction.

A fracture length is characterized using $L_{fmax}$, $L_{fa}$, and $L_f$, representing a maximum length, average length, and characteristic length of the fracture, respectively, in mm. The longer the average length and the characteristic length, the more favorable to obtain the greater filling strength.

A fracture dip angle is represented by $\beta_f$, which means an orthographic projection of the wellbore on the fracture surface, in degrees; if the wellbore is considered as a line, the fracture is a face, and the orthographic projection is from 0 to 90°; and the closer the included angle is to 90°, the easier it is to fill a proppant into the reservoir fracture from the wellbore radius direction.

The fracture flatness is represented by $\gamma_f$, which means the degree of fracture flatness, dimensionless. The perfectly flat fracture flatness is defined as 1.0, and the fracture flatness with a curvature up to 90 degrees or more than 90 degrees is defined as 0. The higher the flatness, the more favorable the fracture filling construction.

The fracture density is represented by $P_f$, which means a number of fractures per unit of length, fractures/$m^3$. The greater the fracture density, the easier the filling, and the more favorable to obtain the higher filling strength.

Based on this, the present invention provides a fracture productivity evaluation index for evaluating a fracture productivity:

$$F = w_1 \cdot \frac{w_f}{w_{f0}} + w_2 \cdot \frac{L_f}{L_{f0}} + w_3 \cdot \frac{\beta_f}{90} + w_4 \cdot \gamma_f + w_5 \cdot \frac{\rho_f}{\rho_{f0}}; \quad \text{(I)}$$

in the formula (I), F is the fracture productivity evaluation index, dimensionless; a value of 1 indicates the best productivity; the smaller the value, the worse the productivity;

$w_f$ is a characteristic slit width of the fracture, mm; $w_{f0}$ is a characteristic contrast solid phase particle size, mm; preferably, $w_{f0}$ is an average particle size of a lowest-grade solid phase particle fillable product to be filled;

$L_f$ is a characteristic length of the fracture, mm; $L_{f0}$ is a characteristic contrast slit length, mm; preferably, $L_{f0}$ takes a value of $5*10^4$ mm, or is an average length of a fracture to be filled;

$\beta_f$ is a fracture dip angle, degree; $\gamma_f$ is a fracture flatness, dimensionless; $\rho_f$ is a fracture density, fractures/$m^3$; $\rho_{f0}$ is a characteristic contrast fracture density, fractures/$m^3$, preferably, $\rho_{f0}$ takes a value of 10 fractures/$m^3$; and $w_1$, $w_2$, $w_3$, $w_4$, $w_5$ are weight coefficients for the slit width, slit length, dip angle, flatness, density, respectively, with recommended values of 0.25, 0.25, 0.15, 0.15, 0.2, respectively, dimensionless.

Preferably, the fracture productivity can be determined based on the productivity evaluation index F obtained: if F>0.75, the fracture productivity is rated as "ultra-high abundance fracture development"; if 0.75≥F>0.5, the fracture productivity is rated as "high abundance fracture development"; if 0.5≥F>0.25, the fracture productivity is rated as "medium abundance fracture development"; if 0.25≥F>0.05, the fracture productivity is rated as "weak fracture development"; and if F≤0.05, the fracture productivity is rated as "no fracture development". The determination results are used for characterizing the extent of development of the fracture.

S12, an implementation feasibility index of an artificially assisted filling process is calculated:

The present invention provides an implementation feasibility index of the artificially assisted filling process by continuing to consider a reservoir strength and a particle size range of the proppant on the basis of the fracture productivity evaluation index of the natural fracture:

$$G = w_6 \cdot \frac{S_b - S_f}{S_b} + w_7 \cdot \frac{P_{f0} - P_f}{P_{f0}} + w_8 \cdot \frac{w_f}{w_{f0}}; \quad \text{(II)}$$

in formula (II), G is the implementation feasibility index of the artificially assisted filling process, dimensionless, which is used for characterizing degrees of matching of the fracture productivity with the proppant; $S_b$ is a reservoir matrix strength, MPa; $S_f$ is a cementitious strength of a proppant of a fractured reservoir, MPa; $P_{f0}$ is a reservoir large fracture rupture pressure which specifically refers to a pressure required to open a formation without fractures in conventional fracturing construction, MPa; $P_f$ is a reservoir natural fracture opening pressure which specifically refers to a pressure used to open the fracture against the ground stress in case that fractures already exist in the formation, MPa; $w_6$, $w_7$, $w_8$ are weight coefficients, taking recommended values of 0.25, 0.25, 0.5, respectively.

S13, one process in technologies of artificially assisted filling for sand and water cooperative control of the fractured reservoir for filling is selected based on the fracture productivity evaluation index F obtained in step S11 and the implementation feasibility index G of the artificially assisted filling process obtained in step S12, with the recommended filling processes and the recommended reasons are as shown in Table 1:

TABLE 1

Selection for filling process of fractured reservoir

| Fracture productivity evaluation index F | Process implementation feasibility index G | Recommended process type | Recommended reason |
|---|---|---|---|
| F > 0.75 | G > 0.35 | Natural micro-saturation filling process | Ultra-high abundance fracture development Extremely easy to construct |
| | G ≤ 0.35 | Artificially assisted extrusion supersaturation filling process | Ultra-high abundance fracture development Difficult to construct |
| 0.75 ≥ F > 0.5 | G > 0.5 | Artificially assisted extrusion supersaturation filling process | High abundance fracture development Extremely easy to construct |
| | G ≤ 0.5 | Artificially assisted fracturing strong saturation filling process | High abundance fracture development Difficult to construct |
| 0.5 ≥ F > 0.25 | G > 0.75 | Artificially assisted extrusion supersaturation filling process | Medium abundance fracture development Extremely easy to construct |
| | G ≤ 0.75 | Artificially assisted fracturing strong saturation filling process | Medium abundance fracture development Difficult to construct |
| 0.25 ≥ F > 0.05 | | Artificially assisted fracturing strong saturation filling process | Weak fracture development |
| F ≤ 0.05 | | Not applicable or artificially assisted fracturing strong saturation filling process | No fracture development |

Further, in step S13, the specific operation steps of the filling are:

S131, opening a casing gate, and washing a well with a washing fluid circularly, where a well bottom pump pressure used for washing the well is Pta, a displacement is Qa, and the well bottom pump pressure Pta and the displacement Qa are empirically set and generally lower than the well bottom pump pressure Pw and the displacement Q;

S132, closing the casing gate, and extruding solid phase particles with a filling particle size $d_{a0}$ into a natural fracture, where a well bottom pump pressure used for extruding is Pw, a displacement is Q, and a sand ratio is Rs; and S133, opening the casing gate, and changing to perform wellbore circulating filling with solid phase particles having a particle size greater than $d_{a0}$, where a particle size of the solid particles filled in the wellbore is increased by one fraction relative to the particle size of the fracture filling in order to reduce the wellbore flow resistance, a well bottom pump pressure for wellbore circulating filling is Pw, and a displacement is Q.

The natural micro-saturation filling process, the artificially assisted extrusion supersaturation filling process, and the artificially assisted fracturing strong saturation filling process differ in specific operation in that solid phase particles used for extruded filling in step S132 is different in particle size $d_{a0}$, well bottom pump pressure Pw, displacement Q, and sand ratio Rs.

Further, preferred filling parameters for the three filling processes are designed as shown in Table 2:

TABLE 2

Design of filling parameters for three filling processes for fractured reservoir

| Filling process | Natural micro-saturation filling process | Artificially assisted extrusion supersaturation filling process | Artificially assisted fracturing strong saturation filling process |
|---|---|---|---|
| Proppant particle size $d_{a0}$/mm | $d_{a0} > 0.8$ | $0.045 < d_{a0} < 0.8$ | $0 < d_{a0} < 0.045$ |
| Expected filling radial depth/m | 10-15 | 10-30 | 20-40 |
| Expected filling strength/($m^3$/m) | 0.02-0.25 | 0.05-0.3 | 0.2-0.5 |
| Expected filling capacity/$m^3$ | 12-20 | 10-15 | 8-15 |

Further, preferred construction parameters for the three filling processes are shown in Table 3, where Pw is the well bottom pump pressure, and Pc is the fracture closure stress. The fracture closure stress Pc refers to an average pressure of a fluid in a smallest fracture acting on the fracture surface where the fracture has been opened, thus controlling the opening of a natural fracture requires controlling the well bottom pump pressure Pw to be greater than the fracture closure stress Pc.

TABLE 3

Design of construction parameters for three filling processes for fractured reservoir

| Filling process | Natural micro-saturation filling process | Artificially assisted extrusion supersaturation filling process | Artificially assisted fracturing strong saturation filling process |
|---|---|---|---|
| Construction pump pressure/MPa | 0 < Pw − Pc < 1 MPa | 1 < Pw − Pc < 2 MPa | 2 < Pw − Pc < 4 MPa |
| Construction sand ratio Rs/% | 80-120 | 60-140 | 40-160 |
| Construction displacement Q/($m^3$/min) | 1-1.5 | 1.5-2.5 | 2-4 |

The present invention also discloses a method for evaluating a filling effect of a fractured reservoir, which can evaluate the fractured reservoir filled by the filling method according to the present invention or a fractured reservoir filled by an existing filling method, including the following steps:

S21, calculating a post-construction fracture filling ratio, a production fluid moisture content, a daily average oil production, an oil well water breakthrough time, and an output fluid sand content, $$\alpha = \frac{V_c}{V_s}; \tag{V}$$

in formula (V), α is a fracture filling ratio, dimensionless; $V_c$ is an amount of gravels pumped into a fracture during construction, $m^3$; $V_s$ is a calculated total volume of a fracture, $m^3$;

$$V_c = V_a - V_b; \tag{VI}$$

in formula (VI), $V_a$ is a total amount of gravels pumped into a formation during construction, $m^3$; $V_b$ is a horizontal well wellbore annulus volume, $m^3$;

$$\beta = 1 - \frac{nR_a}{\sum_i^n R_{bi}}; \tag{VII}$$

in formula (VII), β is a production fluid moisture content, dimensionless; n is a number of non-construction wells, dimensionless; $R_a$ is an output fluid moisture content of construction wells, dimensionless; $R_{bi}$ is an output fluid moisture content of an ith non-construction well, i=1, 2, 3 . . . n;

$$\gamma = \frac{\sum_i^n Q_{bi}}{nQ_a}; \tag{VIII}$$

in formula (VIII), γ is a daily average oil production, dimensionless; $Q_a$ is a daily oil production of a construction well, tons; $Q_{bi}$ is a daily oil production of an ith non-construction well, tons;

$$\zeta = 1 - \frac{\sum_i^n T_{bi}}{nT_a}; \quad \text{(IX)}$$

in formula (IX), $\zeta$ is an oil well water breakthrough time, dimensionless; $T_{bi}$ is a water breakthrough time of an ith non-construction well, days; $T_a$ is a water breakthrough time of a construction well, days;

$$\eta = \frac{n\eta_a}{\sum_i^n \eta_{bi}}; \quad \text{(X)}$$

in formula (X), $\eta$ is an output fluid sand content, dimensionless; $\eta_{bi}$ is an average sand content of fluid output by an ith non-construction well, dimensionless; $\eta_a$ is a sand content of fluid output by a construction well, dimensionless;

in each of the above parameters, the calculated total volume of the fracture $V_s$ is obtained by logging or seismic inversion, and other parameters are common oil well production data;

S22, calculating a comprehensive evaluation index for sand control and water control:

$$N = a\alpha + b\beta + c\gamma + d\zeta + f\eta; \quad \text{(XI)}$$

in formula (XI), N is a comprehensive evaluation index for sand control and water control, dimensionless; a, b, c, d, f are weight coefficients, taking values of 0.4, 0.2, 0.15, 0.15, 0.1, respectively; and S23, evaluating the filling effect of the fractured reservoir based on the comprehensive evaluation index N for sand control and water control obtained in step S22:

when 0.2≥N>0, it is loose filling with a poor filling effect; when 0.5≥N>0.2, it is generally dense filling with a general filling effect; when 0.7≥N>0.5, it is dense filling with a good filling effect; and when 1.0≥N>0.7, it is highly dense filling with an excellent filling effect.

By adopting the above technical solutions, the present invention has the following beneficial effects:

The present invention provides a method for filling a natural fracture of a reservoir, which can correspondingly select a natural micro-saturation filling process, an artificially assisted extrusion supersaturation filling process or an artificially assisted fracturing strong saturation filling process for filling according to a width distribution range, fracture length, fracture dip angle, and fracture density of the natural fracture of the reservoir, as well as a degree of matching of the natural fracture to available precipitation sand control proppants, thereby suiting the remedy to the case and effectively ensuring a sand controlling and water control effect.

The present invention further provides preferred filling technical parameters and construction parameter ranges of the natural micro-saturation filling process, the artificially assisted extrusion supersaturation filling process and the artificially assisted fracturing strong saturation filling process, thereby providing an embodiment of a system covering fracture productivity evaluation, process implementation feasibility evaluation, process type selection, and process parameter optimization for sand control and water control of fractured oil and gas reservoirs.

The method for evaluating the filling effect of the fractured reservoirs provided by the present invention performs overall and comprehensive evaluation on the artificially assisted filling process of the fractured reservoirs from various parameters such as a filling ratio, daily average oil production, output fluid moisture content, oil well water breakthrough time, and output fluid sand content, the results are good, the method is simple and fast, and the practicality is strong.

Figure 1:
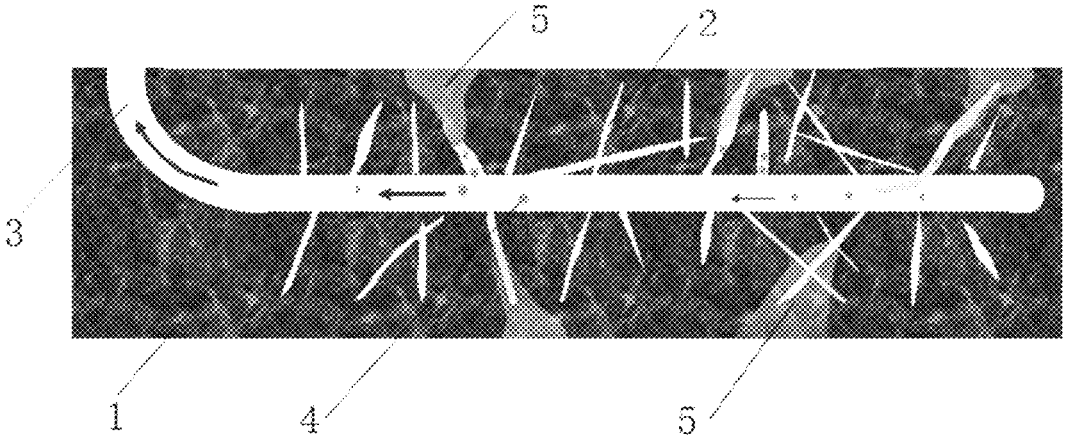
FIG. 1 is a schematic diagram of sand production and water production during an exploitation process of a fractured reservoir.
Figure 2:
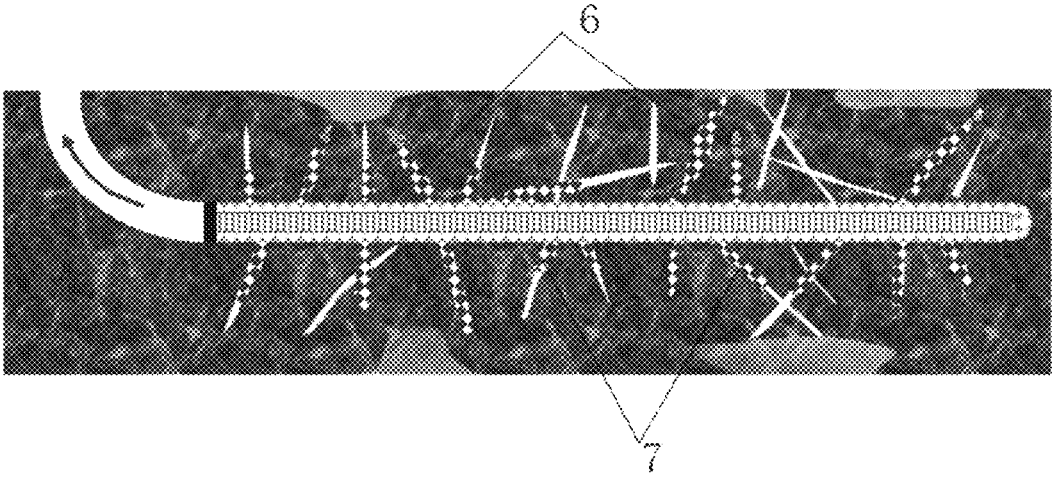
FIG. 2 is a schematic diagram illustrating a technical principle of cooperative control of sand control and water control by using artificially assisted filling for the fractured reservoir.
Figure 3A:
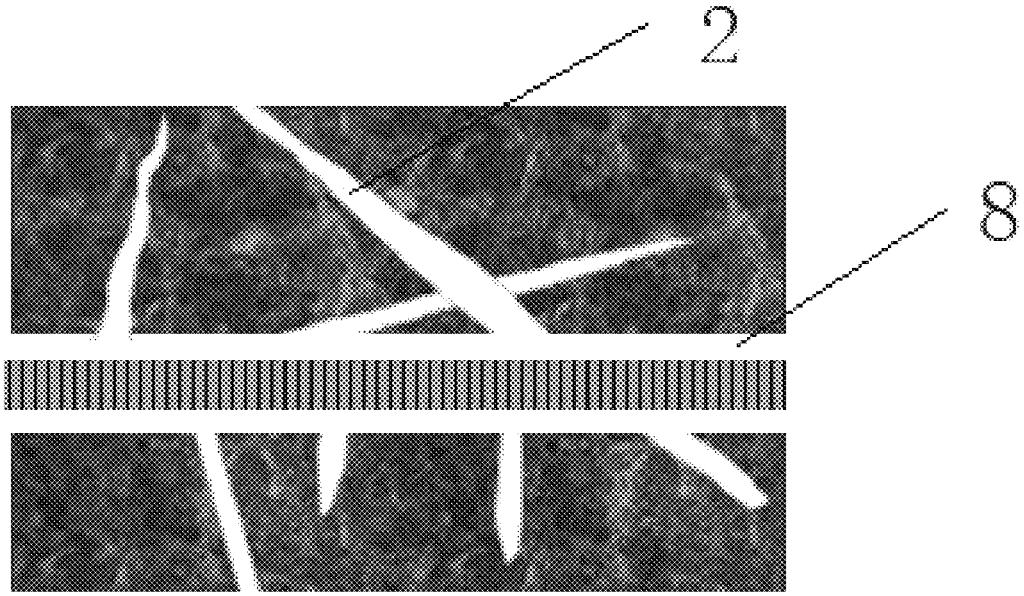
FIG. 3*a* is a schematic representation of a state of a natural fracture with a larger width before filling.
Figure 3B:
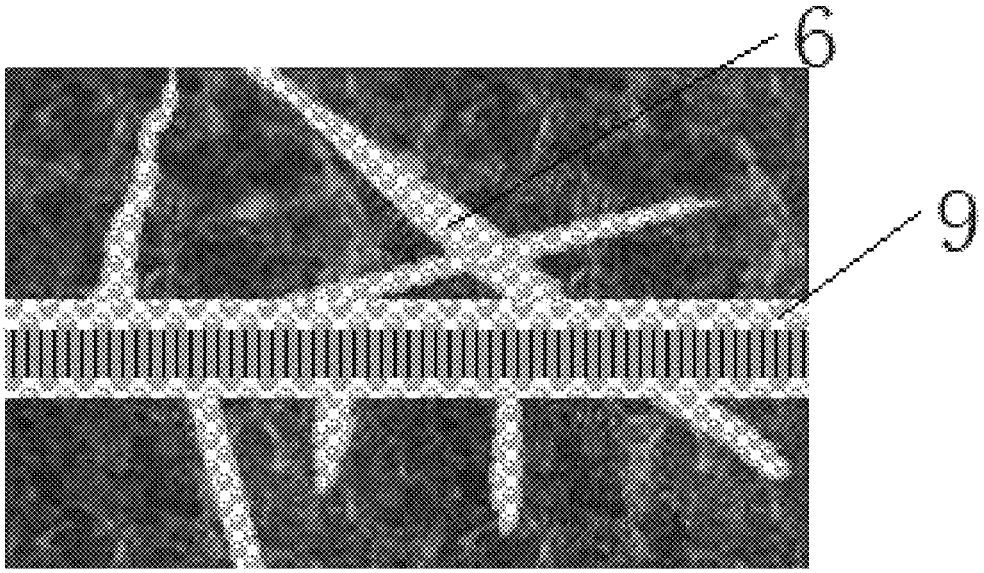
FIG. 3*b* is a schematic view of the natural fracture of FIG. 3*a* after filling using a natural micro-saturation filling process.
Figure 4A:
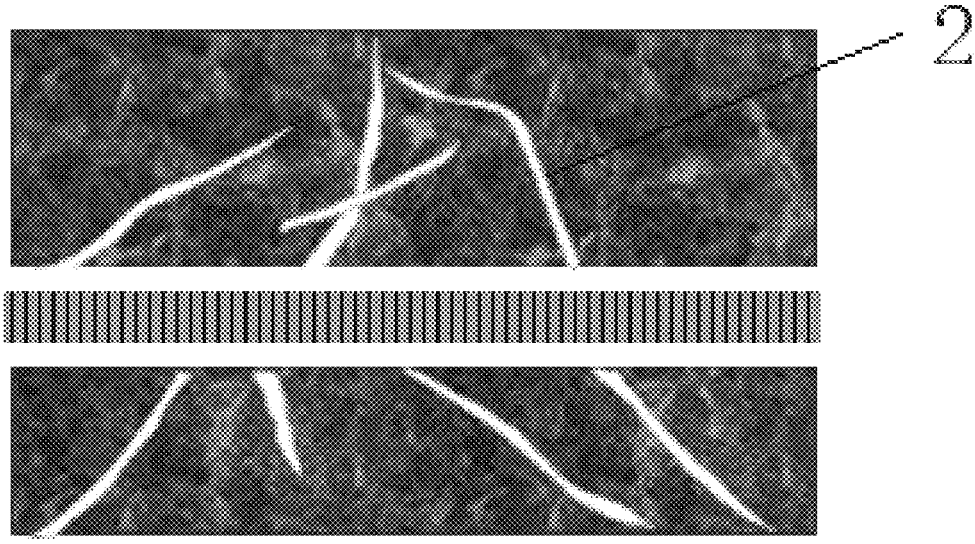
FIG. 4*a* is a schematic view of a state of a natural fracture with a smaller width before filling.
Figure 4B:
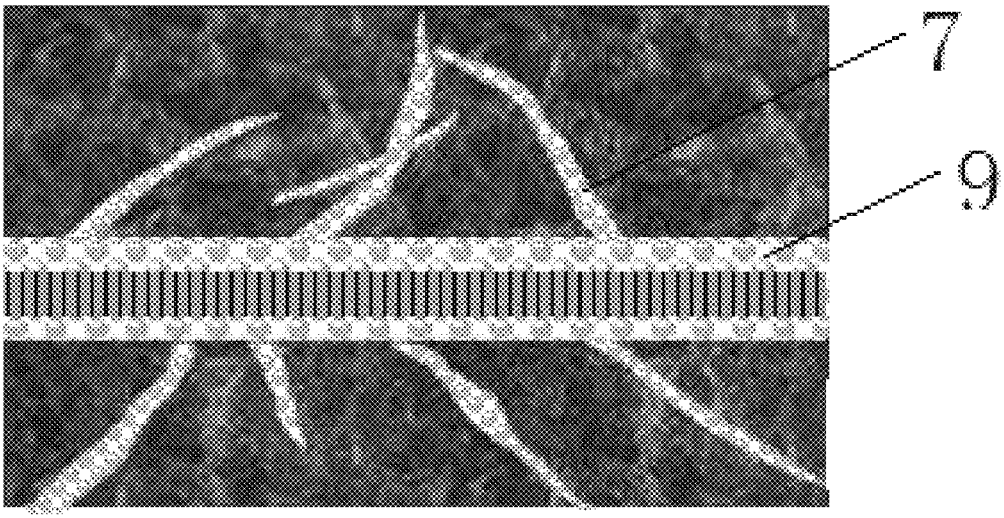
FIG. 4*b* is a schematic view of the natural fracture of FIG. 4*a* after filling using the artificially assisted extrusion supersaturation filling process.
Figure 5A:
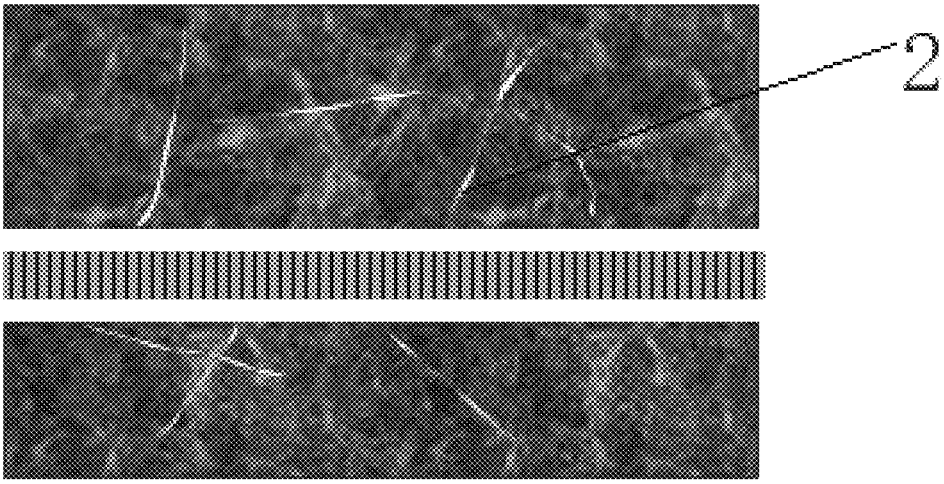
FIG. 5*a* is a schematic representation of a state of a natural fracture with a very small width before filling.
Figure 5B:
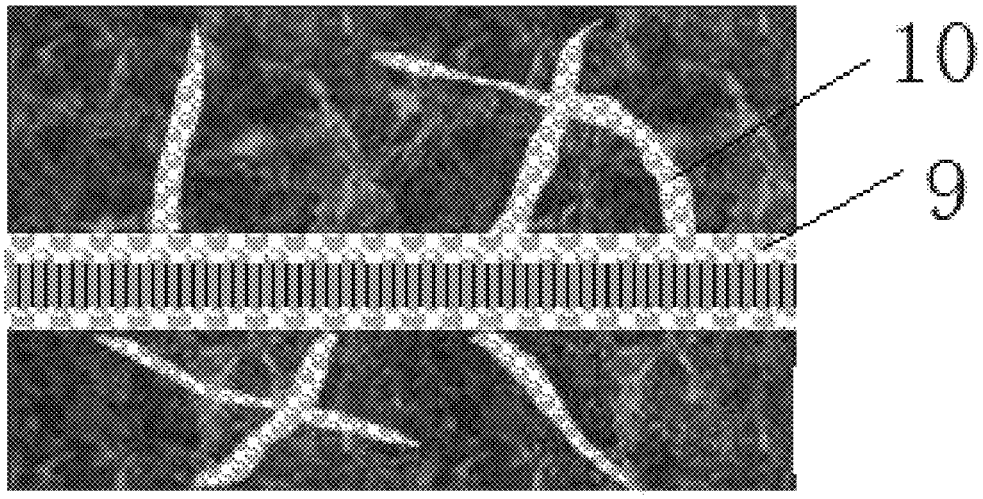
FIG. 5*b* is a schematic view of the natural fracture of FIG. 5*a* after filling using an artificially assisted fracturing strong saturation filling process.

In the drawings, 1—fractured reservoir, 2—natural fracture, 3—wellbore, 4—reservoir produced sand particle, 5—edge and bottom water, 6—natural fracture after filling using natural micro-saturation filling process, 7—natural fracture after filling using artificially assisted extrusion supersaturation filling process, 8—wellbore annulus portion, 9—wellbore annulus portion after filling, 10—natural fracture after filling using artificially assisted fracturing strong saturation filling process.

DETAILED DESCRIPTION OF THE EMBODIMENTS

The technical solution in the embodiments of the present invention will be clearly and completely described below. Apparently, the described embodiments are only some rather than all of the embodiments of the present invention. All other embodiments obtained by a person of ordinary skill in the art based on the embodiments of the present invention without creative efforts shall fall within the protection scope of the present invention.

Embodiment 1

The present embodiment discloses a method of artificially assisted filling for sand control and water control of a fractured reservoir, and basic information of the fractured reservoir of the present embodiment is as follows:

The structural features of a certain block in the Bohai Sea in a domestic sea are: overall fault control semi-anticlinal, declining northeast, and saddle-like at high sites; and reservoir features are: primordial metamorphic granite, with dual pore medium features, main reservoir spaces being fractures, and strong heterogeneity. Weathering bands and submersible curtains are provided from top to bottom.

Basic data of an oil well is shown in Table 4:

TABLE 4

| Basic data of oil well | | | | |
|---|---|---|---|---|
| Reservoir type | Well depth, m | Porosity, % | Fracture density, fractures/$m^3$ | Fracture opening, μm |
| Submersible dual-medium massive oil reservoir | 2520 | 8.8 | 2.6 | 552 |
| Surface crude oil density, g/$cm^3$ | Formation crude oil viscosity, mPa · s | Dissolved gas oil ratio, $m^3/m^3$ | Bulk coefficient | Average oil layer thickness, m |
| 0.844 | 0.18 | 55 | 1.336 | 75 |

Weathering bands are strongly subjected to weathering leaching, predominantly in fracture-pore type or pore-fracture type; the reservoir is well developed and is as a major productive segment; as a result of statistics, the overall distribution of the fracture opening around the well is 100-300 μm, with a maximum of 500 μm; the maximum fracture size of the interval of interest in the present well region is considered to be about 800-1000 μm after taking into account the dissolution and erosion pore characteristics and combining with rock-like observations.

The fracture productivity evaluation index F and the implementation feasibility index G of the artificially assisted filling process of the fractured reservoir of the present embodiment are calculated using formula (I) to formula (II) according to the present invention, with basic data used for calculation as shown in Table 5 and Table 6.

TABLE 5

| Basic data used for calculating F | | | | | | |
|---|---|---|---|---|---|---|
| $w_f$/mm | $w_{fo}$/mm | $L_f$/mm | $L_{fo}$/mm | $\beta_f$/° | $Y_f$ | $\rho_f$ |
| 0.5 | 0.64 | 35 | 50 | 80 | 0.7 | 2.6 |
| $\rho_{fo}$ | $w_1$ | $w_2$ | $w_3$ | $w_4$ | $w_5$ | |
| 10 | 0.25 | 0.25 | 0.15 | 0.15 | 0.2 | |

TABLE 6

| Basic data used for calculating G | | | |
|---|---|---|---|
| $S_b$/MPa | $S_f$/MPa | $P_{f0}$/MPa | $P_f$/MPa |
| 15.2 | 8.8 | 35 | 29.5 |
| $W_6$ | $W_7$ | $W_8$ | |
| 0.25 | 0.25 | 0.5 | |

F=0.661 and G=0.535 are calculated, and the recommended process type is selected from Table 1 to be the artificially assisted extrusion supersaturation filling process, with the specific operation steps as follows:

1. Opening a casing gate, and washing a well with a washing fluid circularly, where a pump pressure used for washing the well is 12.5 Mpa, and a displacement is 0.8 $m^3$/min;
2. Parametric design: an expected filling radial depth is 28 m, an expected filling strength is 0.25 $m^3$/m, and an expected filling capacity is 14.5 $m^3$;
3. Closing the casing gate, performing the artificially assisted extrusion supersaturation filling process, replacing a liquid with a sand carrying liquid, and selecting a proppant particle size median of 0.64 mm, a filling displacement of 1.8 $m^3$/min, a construction sand ratio of 120% and a design construction pump pressure of Pw−Pc=1.8 MPa according to a fracture size;
4. Opening the casing gate, starting annulus filling, using a solid phase particle size median of 0.72 mm, keeping the displacement and sand ratio in step 2 constant for cyclic filling, stopping a pump after sharp pressure rise, and ending construction.

Actual filling parameters: a filling radial depth is 24 m, a filling strength is 0.22 $m^3$/m, and a filling capacity is 13.25 $m^3$.

Embodiment 2

The present embodiment discloses a method for evaluating a filling effect of a fractured reservoir, specifically, a method for evaluating a filling effect after three months from the end of construction of Embodiment 1:

The comprehensive evaluation index N for filling for sand control and water control is calculated using formula (V) to formula (XI) according to the present invention, with basic data used for calculation as shown in Table 7:

TABLE 7

| Basic data used for calculating N | | | |
|---|---|---|---|
| $V_c$ | $V_s$ | $V_a$ | $V_b$ |
| 11.65 $m^3$ | 14 $m^2$ | 13.5 $m^3$ | 1.85 $m^3$ |
| $R_a$ | $\Sigma_i^n R_{bi}/n$ | $Q_a$ | $\Sigma_i^n Q_{bi}/n$ |
| 50 | 88 | 55 tons | 34 tons |
| $\Sigma_i^n T_{bi}/n$ | $T_a$ | $\Sigma_i^n \eta_{bi}/n$ | $\eta_a$ |
| 45 days | 90 days | 0.05 | 0.01 |

N is calculated to be 0.61, and the filling effect of the fractured reservoir is evaluated as dense filling, with a good filling effect.

The above embodiments are only used to illustrate the technical solutions of the present invention rather than limiting thereto. Although the present invention has been described in detail with reference to the above embodiments, the technical solutions recited in the above embodiments may still be modified by those of ordinary skill in the art, or some or all of the technical features thereof may be replaced with equivalents. These modifications or replacements do not make the essence of the corresponding technical solution deviate from the scope of the technical solutions in the embodiments of the present invention, and all of them shall be covered within the scope of the claims and the description of the present invention.

What is claimed is:

1. A method of artificially assisted filling for sand control and water control of a fractured reservoir, comprising the steps:

S11, calculating a fracture productivity evaluation index of the fractured reservoir:

$$F = w_1 \cdot \frac{w_f}{w_{f0}} + w_2 \cdot \frac{L_f}{L_{f0}} + w_3 \cdot \frac{\beta_f}{90} + w_4 \cdot \gamma_f + w_5 \cdot \frac{\rho_f}{\rho_{f0}}; \quad \text{(I)}$$

in formula (I), F is the fracture productivity evaluation index, dimensionless; $w_f$ is a characteristic slit width of a fracture, mm; $w_{f0}$ is a characteristic contrast proppant particle size, mm; $L_f$ is a characteristic length of a fracture, mm; $L_{f0}$ is a characteristic contrast slit length, mm; $\beta_f$ is a fracture dip angle, degree; $\gamma_f$ is a fracture flatness, dimensionless; $\rho_f$ is a fracture density, fractures/$m^3$; $\rho_{f0}$ is a characteristic contrast fracture density, fractures/$m^3$; $w_1$, $w_2$, $w_3$, $w_4$, $w_5$ are weight coefficients, taking values of 0.25, 0.25, 0.15, 0.15, 0.2, respectively, dimensionless;

S12, calculating an implementation feasibility index of an artificially assisted filling process:

$$G = w_6 \cdot \frac{s_b - s_f}{s_b} + w_7 \cdot \frac{P_{f0} - P_f}{P_{f0}} + w_8 \cdot \frac{w_f}{w_{f0}}; \quad \text{(II)}$$

in formula (II), G is the implementation feasibility index of the artificially assisted filling process, dimensionless; $S_b$ is a reservoir matrix strength, MPa; $S_f$ is a cementitious strength of a proppant, MPa; $P_{f0}$ is a reservoir large fracture rupture pressure, MPa; $P_f$ is a reservoir natural fracture opening pressure, MPa; $w_6$, $w_7$, $w_8$ are weight coefficients, taking values of 0.25, 0.25, 0.5, respectively;

S13, selecting and performing one process in technologies of artificially assisted filling for sand control and water control of the fractured reservoir for filling based on the fracture productivity evaluation index F obtained in step S11 and the implementation feasibility index G of the artificially assisted filling process obtained in step S12, wherein:

when F>0.75 and G>0.35, a natural micro-saturation filling process is selected for filling; when F>0.75 and G≤0.35, an artificially assisted extrusion supersaturation filling process is selected for filling;

when 0.75≥F>0.5 and G>0.5, an artificially assisted extrusion supersaturation filling process is selected for filling; when 0.75≥F>0.5 and G≤0.5, an artificially assisted fracturing strong saturation filling process is selected for filling;

when 0.5≥F>0.25 and G>0.75, an artificially assisted extrusion supersaturation filling process is selected for filling; when 0.5≥F>0.25 and G≤0.75, an artificially assisted fracturing strong saturation filling process is selected for filling;

when 0.25≥F>0.05, an artificially assisted fracturing strong saturation filling process is selected for filling;

and when F≤0.05, no filling is performed or an artificially assisted fracturing strong saturation filling process is selected for filling;

wherein:

filling technology parameters of the natural micro-saturation filling process comprise $d_{a0}$>0.12 mm and construction parameters of the natural micro-saturation filling process comprise: 0 MPa<Pw−Pc<1 MPa, a sand ratio Rs of 80-120%, and a displacement Q of 1-1.5 $m^3$/min;

filling technical parameters of the artificially assisted extrusion supersaturation filling process comprise 0.045 mm<$d_{a0}$<0.12 mm and construction parameters of the artificially assisted extrusion supersaturation filling process are: 1<Pw−Pc<2 MPa, a sand ratio Rs of 60-140%, and a displacement Q of 1.5-2.5 $m^3$/min; and filling technology parameters of the artificially assisted fracturing strong saturation filling process comprise 0 mm<$d_{a0}$<0.045 mm and construction parameters of the artificially assisted fracturing strong saturation filling process are: 2<Pw−Pc<4 MPa, a sand ratio Rs of 40-160%, and a displacement Q of 2-4 $m^3$/min;

wherein $d_{a0}$ is a filling particle size, Pw is a well bottom pump pressure, Pc is a fracture closure stress, Rs is a sand ratio, and Q is a displacement;

wherein the performing in step S13 comprises the following steps:

S131, opening a casing gate, and washing a well with a washing fluid circularly, wherein a well bottom pump pressure used for washing the well is Pta, and a displacement is Qa;

S132, closing the casing gate, and extruding solid phase particles with a filling particle size dao into a natural fracture, where a well bottom pump pressure used for extruding is Pw, a displacement is Q, and a sand ratio is Rs; and S133, opening the casing gate, and changing to perform wellbore circulating filling with solid phase particles having a particle size greater than dao, wherein a well bottom pump pressure for wellbore circulating filling is Pw, and a displacement is Q;

the natural micro-saturation filling process, the artificially assisted extrusion supersaturation filling process, and the artificially assisted fracturing strong saturation filling process differ in particle size $d_{a0}$, well bottom pump pressure Pw, displacement Q, and sand ratio Rs.

2. The method of artificially assisted filling for sand control and water control of the fractured reservoir according to claim 1, wherein a calculation method for the $w_f$ is:

$$w_f = 0.5(w_{fa} + w_{fmax}); \text{ and} \quad \text{(III)}$$

in formula (III), $w_{fa}$ is an average slit width of a fracture, mm, and $w_{fmax}$ is a maximum slit width of a fracture, mm.

3. The method of artificially assisted filling for sand control and water control of the fractured reservoir according to claim 1, wherein a calculation method for the $L_f$ is:

$$L_f = 0.5(L_{fa} + L_{fmax}); \quad \text{(IV)}$$

in formula (IV), $L_{fa}$ is an average length of a fracture, mm; and $L_{fmax}$ is a maximum length of a fracture, mm.

4. The method of artificially assisted filling for sand control and water control of the fractured reservoir according to claim 1, wherein the $w_{f0}$ is an average particle size of a proppant fillable product to be filled.

5. The method of artificially assisted filling for sand control and water control of the fractured reservoir according to claim 1, wherein the $L_{f0}$ takes a value of $5*10^4$ mm, or is an average length of a fracture to be filled; and the $\rho_{f0}$ takes a value of 10 fractures/$m^3$.

6. The method of artificially assisted filling for sand control and water control of the fractured reservoir according to claim 1, wherein filling technology parameters of the natural micro-saturation filling process, further comprise: an expected filling radial depth of 10-15 m, an expected filling strength of 0.02-0.25 $m^3$/m, and an expected filling capacity of 12-20 $m^3$;

filling technical parameters of the artificially assisted extrusion supersaturation filling process, further comprise: an expected filling radial depth of 10-30 m, an expected filling strength of 0.05-0.3 $m^3$/m, and an expected filling capacity of 10-15, $m^3$; and filling technology parameters of the artificially assisted fracturing strong saturation filling process, further comprise: an expected filling radial depth of 20-40 m, an expected filling strength of 0.2-0.5 $m^3$/m, and an expected filling capacity of 8-15 $m^3$.

7. The method of artificially assisted filling for sand control and water control of the fractured reservoir according to claim 1, wherein step S11 further comprises: performing fracture productivity determination based on the productivity evaluation index F obtained by calculation:

if F>0.75, the fracture productivity is rated as "ultra-high abundance fracture development"; if 0.75≥F>0.5, the fracture productivity is rated as "high abundance fracture development"; if 0.5≥F>0.25, the fracture productivity is rated as "medium abundance fracture development"; if 0.25≥F>0.05, the fracture productivity is rated as "weak fracture development"; and if F≤0.05, the fracture productivity is rated as "no fracture development".

8. A method for evaluating a filling effect of a fractured reservoir filling using the method of artificially assisted filling for sand control and water control of the fractured reservoir according to claim 1, comprising the steps:

S21, calculating a post-construction fracture filling ratio, a production fluid moisture content, a daily average oil production, an oil well water breakthrough time, and an output fluid sand content, $$\alpha = \frac{V_c}{V_s}; \tag{V}$$

in formula (V), α is a fracture filling ratio, dimensionless; $V_c$ is an amount of gravels pumped into a fracture during construction, $m^3$; $V_s$ is a calculated total volume of a fracture, $m^3$;

$$V_c = V_a - V_b; \tag{VI}$$

in formula (VI), $V_a$ is a total amount of gravels pumped into a formation during construction, $m^3$; $V_b$ is a horizontal well wellbore annulus volume, $m^3$;

$$\beta = 1 - \frac{nR_a}{\sum_i^n R_{bi}}; \tag{VII}$$

in formula (VII), β is a production fluid moisture content, dimensionless; n is a number of non-construction wells, dimensionless; $R_a$ is an output fluid moisture content of construction wells, dimensionless; $R_{bi}$ is an output fluid moisture content of an ith non-construction well, i=1, 2, 3 . . . n;

$$\gamma = \frac{\sum_i^n Q_{bi}}{nQ_a}; \tag{VIII}$$

in formula (VIII), γ is a daily average oil production, dimensionless; $Q_a$ is a daily oil production of a construction well, tons; $Q_{bi}$ is a daily oil production of an ith non-construction well, tons;

$$\zeta = 1 - \frac{\sum_i^n T_{bi}}{nT_a}; \tag{IX}$$

in formula (IX), ζ is an oil well water breakthrough time, dimensionless; $T_{bi}$ is a water breakthrough time of an ith non-construction well, days; $T_a$ is a water breakthrough time of a construction well, days;

$$\eta = \frac{n\eta_a}{\sum_i^n \eta_{bi}}; \tag{X}$$

in formula (X), η is an output fluid sand content, dimensionless; $\eta_{bi}$ is an average sand content of fluid output by an ith non-construction well, dimensionless; $\eta_a$ is a sand content of fluid output by a construction well, dimensionless;

S22, calculating a comprehensive evaluation index for sand control and water control:

$$N = a\alpha + b\beta + c\gamma + d\zeta + f\eta; \tag{XI}$$

in formula (XI), N is a comprehensive evaluation index for sand control and water control, dimensionless; a, b, c, d, f are weight coefficients, taking values of 0.4, 0.2, 0.15, 0.15, 0.1, respectively; and S23, evaluating the filling effect of the fractured reservoir based on the comprehensive evaluation index N for sand control and water control obtained in step S22:

when 0.2≥N>0, it is loose filling with a poor filling effect; when 0.5≥N>0.2, it is generally dense filling with a general filling effect; when 0.7≥N>0.5, it is dense filling with a good filling effect; and when 1.0≥N>0.7, it is highly dense filling with an excellent filling effect.

* * * * *